US009722366B2

(12) United States Patent
Gailus

(10) Patent No.: US 9,722,366 B2
(45) Date of Patent: Aug. 1, 2017

(54) ELECTRICAL CONNECTOR INCORPORATING CIRCUIT ELEMENTS

(71) Applicant: Amphenol Corporation, Wallingford, CT (US)

(72) Inventor: Mark W. Gailus, Concord, MA (US)

(73) Assignee: Amphenol Corporation, Wallingford, CT (US)

( * ) Notice: Subject to any disclaimer, the term of this patent is extended or adjusted under 35 U.S.C. 154(b) by 117 days.

(21) Appl. No.: 14/244,479

(22) Filed: Apr. 3, 2014

(65) Prior Publication Data

US 2014/0302718 A1 Oct. 9, 2014

Related U.S. Application Data

(63) Continuation of application No. 13/863,118, filed on Apr. 15, 2013, now Pat. No. 8,734,185, which is a (Continued)

(51) Int. Cl.

| | |
|---|---|
| ***H01R 13/66*** | (2006.01) |
| ***H01R 43/24*** | (2006.01) |
| *H01R 13/6587* | (2011.01) |

(52) U.S. Cl.

CPC ..... *H01R 13/665* (2013.01); *H01R 13/66* (2013.01); *H01R 13/6608* (2013.01); (Continued)

(58) Field of Classification Search

CPC ..... H01R 13/6476; H01R 13/6461; H01R 13/665; H01R 13/6608

See application file for complete search history.

(56) References Cited

U.S. PATENT DOCUMENTS

| | | | |
|---|---|---|---|
| 3,115,379 | A | 12/1963 | McKee |
| 3,825,994 | A | 7/1974 | Coleman |

(Continued)

FOREIGN PATENT DOCUMENTS

| | | | |
|---|---|---|---|
| CN | 101073184 | A | 11/2007 |
| EP | 0212764 | A2 | 3/1987 |

(Continued)

OTHER PUBLICATIONS http://kemet.com/kemet/web/homepage/kechome.nsf/vaprintpages/ceramic, copyright 2003, Kemet Electronic Corp.

(Continued)

*Primary Examiner* — James Harvey
(74) *Attorney, Agent, or Firm* — Blank Rome LLP

(57) ABSTRACT

An electrical connector electrically connects a first printed circuit board and a second printed circuit board, where the electrical connector includes: (a) an insulative housing; (b) a plurality of signal conductors, with at least a portion of each of the plurality of signal conductors disposed within the insulative housing; (c) each of the plurality of signal conductors having a first contact end, a second contact end and an intermediate portion therebetween; and (d) a passive circuit element electrically connected to the intermediate portion of each of the plurality of signal conductors, where the passive circuit element is housed in an insulative package and includes at least a capacitor or an inductor.

19 Claims, 11 Drawing Sheets

Related U.S. Application Data continuation of application No. 12/784,914, filed on May 21, 2010, now abandoned.

(52) U.S. Cl.
CPC ..... *H01R 43/24* (2013.01); *H01R 13/6587* (2013.01); *Y10T 29/49169* (2015.01)

(56) References Cited

U.S. PATENT DOCUMENTS 3,863,181 A 1/1975 Glance et al.
3,978,375 A 8/1976 Fukui et al.
4,464,003 A 8/1984 Goodman et al.
4,596,428 A 6/1986 Tengler
4,655,515 A 4/1987 Hamsher, Jr. et al.
4,675,989 A 6/1987 Galloway et al.
4,705,332 A 11/1987 Sadigh-Behzadi
4,820,169 A 4/1989 Weber et al.
4,824,383 A 4/1989 Lemke
4,846,727 A 7/1989 Glover et al.
4,878,155 A 10/1989 Conley
4,882,554 A 11/1989 Akaba et al.
4,952,172 A 8/1990 Barkus et al.
4,965,933 A 10/1990 Mraz et al.
4,975,069 A 12/1990 Fedder et al.
4,975,084 A 12/1990 Fedder et al.
5,046,960 A 9/1991 Fedder
5,066,236 A 11/1991 Broeksteeg
5,104,341 A 4/1992 Gilissen et al.
5,117,331 A 5/1992 Gebara
5,150,086 A 9/1992 Ito
5,153,540 A 10/1992 Gliha, Jr.
5,163,540 A 11/1992 Mainquist et al.
5,219,827 A * 6/1993 Higaki ..... H01P 7/082 333/219
5,224,867 A 7/1993 Ohtsuki et al.
5,228,824 A 7/1993 Satoyoshi
5,228,864 A 7/1993 Fusselman et al.
5,249,098 A 9/1993 Rostoker et al.
5,280,257 A 1/1994 Cravens et al.
5,286,212 A 2/1994 Broeksteeg
5,287,076 A 2/1994 Johnescu et al.
5,340,334 A 8/1994 Nguyen
5,342,211 A 8/1994 Broeksteeg
5,403,206 A 4/1995 McNamara et al.
5,496,183 A 3/1996 Soes et al.
5,525,066 A 6/1996 Morlion et al.
5,580,283 A 12/1996 O'Sullivan et al.
5,702,258 A 12/1997 Provencher et al.
5,795,191 A 8/1998 Preputnick et al.
5,860,816 A 1/1999 Provencher et al.
5,880,921 A * 3/1999 Tham ..... H01H 59/0009 333/262
5,924,899 A 7/1999 Paagman
5,941,447 A 8/1999 Chu et al.
5,980,321 A 11/1999 Cohen et al.
6,019,616 A 2/2000 Yagi et al.
6,083,047 A 7/2000 Paagman
6,152,742 A 11/2000 Cohen et al.
6,168,469 B1 1/2001 Lu
6,183,301 B1 2/2001 Paagman
6,285,542 B1 9/2001 Kennedy, III et al.
6,325,644 B1 12/2001 Lemke et al.
6,375,510 B2 4/2002 Asao
6,379,188 B1 4/2002 Cohen et al.
6,409,543 B1 6/2002 Astbury, Jr. et al.
6,530,790 B1 3/2003 McNamara et al.
6,537,087 B2 3/2003 McNamara et al.
6,592,382 B2 7/2003 Wurster
6,623,280 B2 9/2003 Oldenburg et al.
6,652,318 B1 11/2003 Winings et al.
6,932,649 B1 8/2005 Rothermel et al.
7,285,018 B2 10/2007 Kenny et al.
7,540,781 B2 6/2009 Kenny et al.
7,887,371 B2 2/2011 Kenny et al.
8,382,524 B2 * 2/2013 Khilchenko ..... H01R 12/724 439/620.09
2002/0098738 A1 * 7/2002 Astbury, Jr. ..... H01R 13/65807 439/607.07
2003/0073349 A1 * 4/2003 Nagao ..... H01R 4/028 439/620.24
2003/0203683 A1 10/2003 Iwasaki
2004/0108587 A1 * 6/2004 Chudzik ..... H01L 23/50 257/700
2004/0110421 A1 6/2004 Broman et al.
2004/0121652 A1 6/2004 Gailus
2005/0032430 A1 2/2005 Otsu et al.
2005/0121224 A1 6/2005 Lien
2005/0283974 A1 12/2005 Richard et al.
2005/0287869 A1 12/2005 Kenny et al.
2006/0068640 A1 3/2006 Gailus
2008/0194146 A1 8/2008 Gailus
2009/0291593 A1 11/2009 Atkinson et al.
2011/0050357 A1 * 3/2011 Kim ..... H01L 23/5227 333/32
2011/0287663 A1 * 11/2011 Gailus ..... H01R 13/66 439/620.21
2012/0094536 A1 * 4/2012 Khilchenko ..... H01R 12/724 439/620.21
2013/0225006 A1 * 8/2013 Khilchenko ..... H01R 12/724 439/660
2014/0302718 A1 * 10/2014 Gailus ..... H01R 13/6608 439/620.21

FOREIGN PATENT DOCUMENTS

EP 0422785 A2 4/1991
EP 0486298 A1 5/1992
EP 0560550 9/1993
EP 1779472 A1 5/2007
GB 2325354 A 11/1998
JP 0569890 9/1993
JP 0613133 1/1994
JP 0629060 2/1994
JP 06054274 A 2/1994
JP 06084557 A 3/1994
JP 0654257 7/1994
JP 0654259 7/1994
JP 06325829 A 11/1994
JP 07006823 A1 1/1995
JP 07027059 A 1/1995
JP 07302649 A 11/1995
JP 9237656 A 9/1997
JP 10162909 A 6/1998
JP 10270124 A 10/1998
JP 10270133 A 10/1998
JP 10275662 A 10/1998
JP 10284194 A 10/1998
JP 10302895 A 11/1998
WO 8805218 A1 7/1988
WO 9638889 A1 12/1996
WO 0031832 A1 6/2000
WO WO-2006002356 A1 1/2006

OTHER PUBLICATIONS

Author Unknown, "Phoenix Contact, 5 New Printed Circut Terminal Blocks," Phoenix Terminal Blocks, Inc., 1997 or earlier, pp. 5., Middletown, PA, USA.

Author Unknown, "Phoenix Contact, New Terminal Block Techonology," Phoenix Terminal Blocks, Inc., 1997 or earlier, pp. 1-36., Middletown, PA, USA.

Author Unknown, "Photographs of Berg Connector Module Bearing Code dnr2180/1.2," 1997 or earlier, 1p. (photographs of module of a connector sold to Berg Electronics. This contact elements are held between two pieces a insulator, which form the two sides of the module. In the photographs, the second side of the module contains grooves into which the loose contacts are placed.

Strawser, "Connecterized Circuitry Utilizing Polymer Thick Film," Methode Electronics, Inc., date unknown, pp. 283-286, Chicago, IL, USA.

(56) References Cited

OTHER PUBLICATIONS

Costlow, "Thick-Film Resistors, Chip Capacitators and Diodes Built on," Electronics Engineering Times, 1988, 3 pp., No. 51, Skokie, IL, USA.
EP Search Report dated Jan. 24, 2012, cited in EP Application No. 11166820.8.

* cited by examiner

ELECTRICAL CONNECTOR INCORPORATING CIRCUIT ELEMENTS

REFERENCE TO RELATED APPLICATIONS

The present application is a continuation of U.S. patent application Ser. No. 13/863,118, filed Apr. 15, 2013, which is a continuation of U.S. patent application Ser. No. 12/784,914, filed May 21, 2010, the disclosures of which are hereby incorporated by reference.

BACKGROUND OF THE INVENTION

This invention relates generally to an electrical connector incorporating passive circuit elements and methods of manufacturing such an electrical connector.

Modern electronic circuitry is often built on printed circuit boards. The printed circuit boards are then interconnected to create an electronic system, such as a server or a router for a communications network. Electrical connectors are generally used to make these interconnections between the printed circuit boards. Typically, connectors are made of two pieces, with one piece on one printed circuit board and the other piece on another printed circuit board. The two pieces of the connector assembly mate to provide signal paths between the printed circuit boards.

A desirable electrical connector should generally have a combination of several properties. For example, it should provide signal paths with appropriate electrical properties such that the signals are not unduly distorted as they move between the printed circuit boards. In addition, the connector should ensure that the two pieces mate easily and reliably. Furthermore, the connector should be rugged so that it is not easily damaged by handling of the printed circuit boards. For many applications, it is also important that the connector have high density, meaning that the connector can carry a large number of electrical signals per unit length.

Examples of electrical connectors possessing these desirable properties include VHDM®. VHDM®-HSD and GbX® connectors manufactured and sold by the assignee of the present invention, Teradyne, Inc.

One of the disadvantages of present electronic systems is the need, often times, to populate the surfaces of the interconnected printed circuit boards with passive circuit elements. These passive circuit elements, such as capacitors, inductors and resistors, are necessary, for example: (i) to block or at least reduce the flow of direct current ("DC") caused by potential differences between various electronic components on the interconnected printed circuit boards; (ii) to provide desired filtering characteristics; and/or (iii) to reduce data transmission losses. However, these passive circuit elements take up precious space on the board surface (thus reducing the space available for signal paths). In addition, where these passive circuit elements on the board surface are connected to conductive vias, there could be undesirable signal reflections at certain frequencies due to impedance discontinuity and resonant stub effects.

What is desired, therefore, is an electrical connector and methods of manufacturing such an electrical connector that generally possesses the desirable properties of the existing connectors described above, but also provides passive circuit elements in the connector to deliver the desired qualities provided by the passive circuit elements described above. And it is further desired that such an electrical connector provide the passive circuit elements cost effectively.

SUMMARY OF THE INVENTION

The objects of the invention are achieved in the preferred embodiment by an electrical connector that electrically connects a first printed circuit board and a second printed circuit board, where the electrical connector includes: (a) an insulative housing; (b) a plurality of signal conductors, with at least a portion of each of the plurality of signal conductors disposed within the insulative housing; (c) each of the plurality of signal conductors having a first contact end, a second contact end and an intermediate portion therebetween; and (d) a passive circuit element electrically connected to the intermediate portion of each of the plurality of signal conductors, where the passive circuit element is housed in an insulative package and includes at least a capacitor or an inductor.

With those and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

The foregoing features of this invention, as well as the invention itself, may be more fully understood from the following description of the drawings in which.

DETAILED DESCRIPTION OF THE PREFERRED EMBODIMENT

Figure 1:
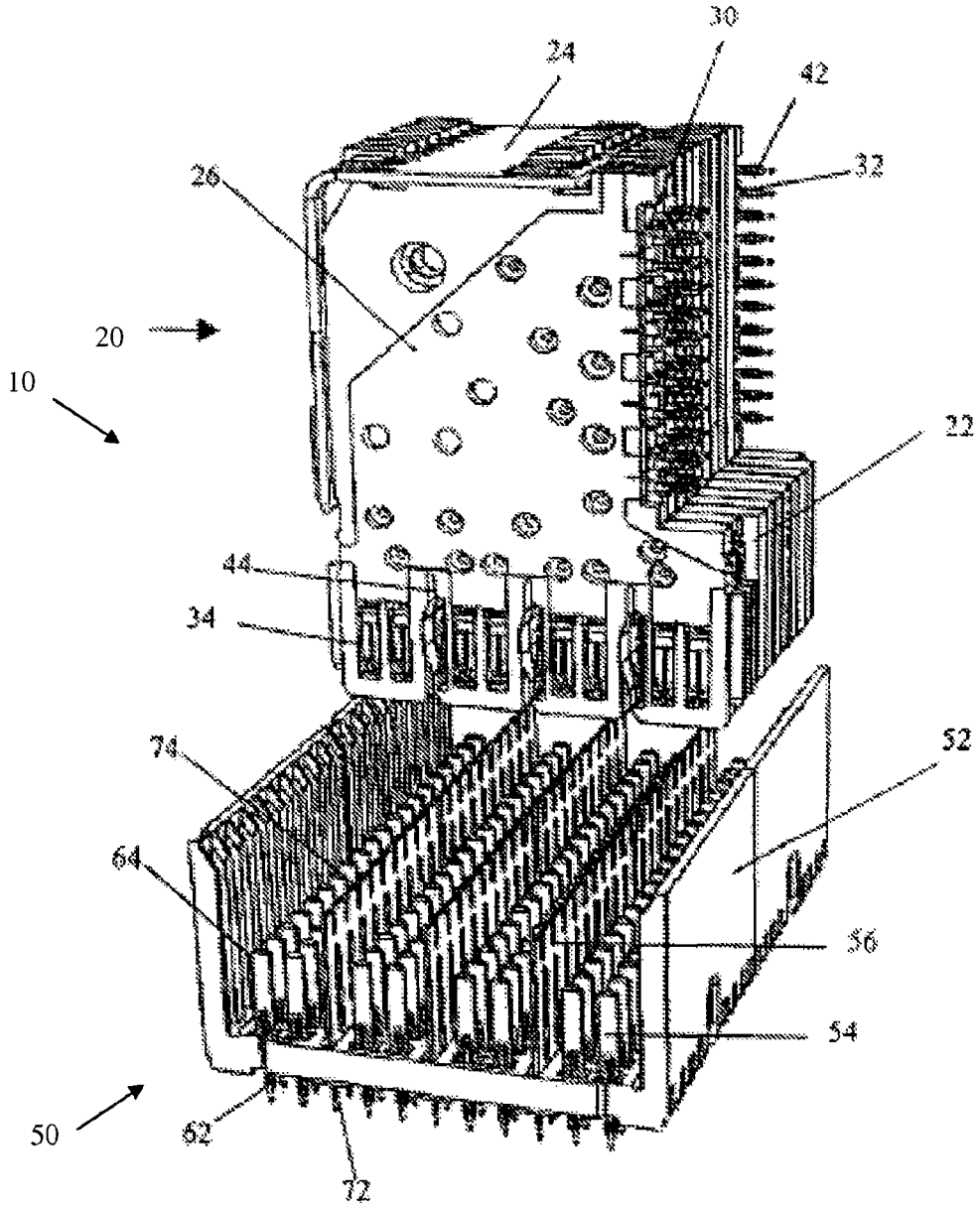
FIG. 1 (PRIOR ART)
FIG. 1 shows a perspective view of a prior art electrical connector assembly illustrated as FIG. 1 in U.S. Pat. No. 6,409,543, where the electrical connector assembly includes a daughtercard connector and a backplane connector.

Several preferred embodiments of the invention are described for illustrative purposes, it being understood that the invention may be embodied in other forms not specifically shown in the drawings.

FIG. 1 shows a perspective view of a prior art electrical connector assembly 10 illustrated as FIG. 1 in U.S. Pat. No. 6,409,543. The '543 patent, which is directed to the GbX® connector, is assigned to the assignee of the present invention and is incorporated by reference herein. The electrical connector assembly 10 includes a daughtercard connector 20 that is connectable to a first printed circuit board (not shown) and a backplane connector 50 that is connectable to a second printed circuit board (not shown). The daughtercard connector 20 has a plurality of modules or wafers 22 which are preferably held together by a stiffener 24.

Each wafer 22 includes a plurality of signal conductors 30, a shield plate (not visible in FIG. 1), and a dielectric housing 26 that is formed around at least a portion of each of the plurality of signal conductors 30 and the shield plate. Each of the signal conductors 30 has a first contact end 32 connectable to the first printed circuit board and a second contact end 34 mateable to the backplane connector 50. Each shield plate has a first contact end 42 connectable to the first printed circuit board and a second contact end 44 mateable to the backplane connector 50.

The general layers of the wafer 22 include an insulative housing layer, a shield plate with contacts layer, an insulative housing layer, conductors layer, and another insulative housing layer. That arrangement necessitates connecting to a ground (shield plate) of a different layer.

The backplane connector 50 includes an insulative housing 52 and a plurality of signal conductors 54 held by the insulative housing 52. The plurality of signal conductors 30, 54 are arranged in an array of differential signal pairs. The backplane connector 50 also includes a plurality of shield plates 56 that are located between rows of differential signal pairs. Each of the signal conductors 54 has a first contact end 62 connectable to the second printed circuit board and a second contact end 64 mateable to the second contact end 34 of the corresponding signal conductor 30 of the daughtercard connector 20. Each shield plate 56 has a first contact end 72 connectable to the second printed circuit board and a second contact end 74 mateable to the second contact end 44 of the corresponding shield plate of the daughtercard connector 20.

As discussed in the Background Of The Invention section, the electrical connector assembly 10 of FIG. 1 does not have passive circuit elements that would provide desirable characteristics, such as DC flow minimization, desired filtering characteristics or data transmission loss reduction.

Figure 2:
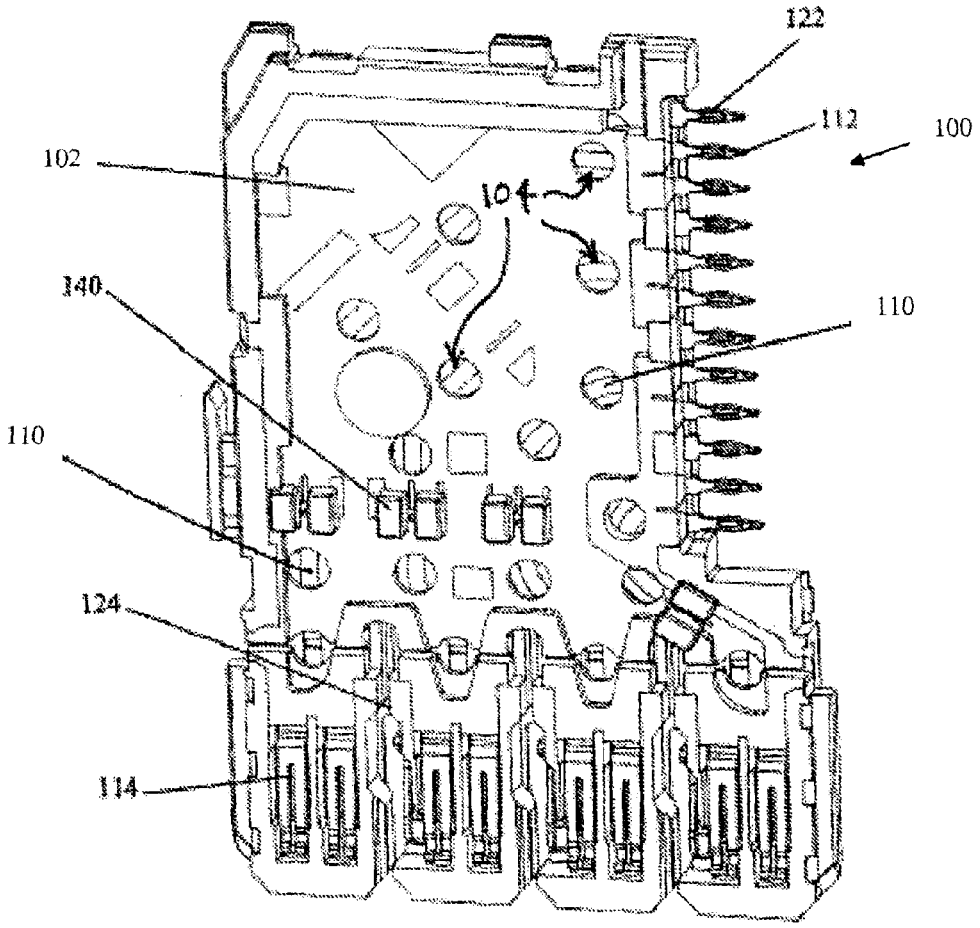
FIG. 2 shows a perspective view of a wafer of a daughtercard connector in accordance with the preferred embodiment of the present invention.
Figure 3:
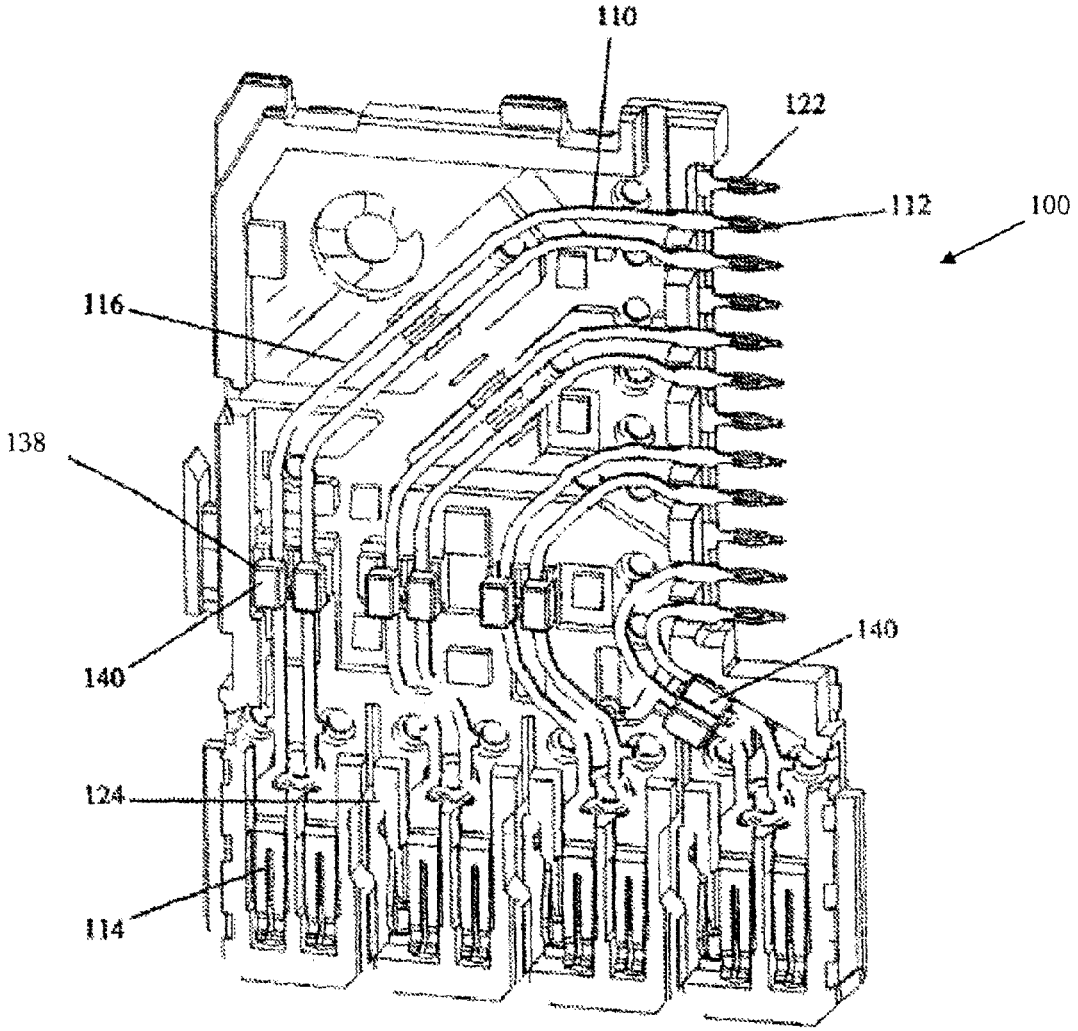
FIG. 3 shows a perspective view of the wafer of FIG. 2, with a portion of an insulative housing removed from the drawing to better illustrate attachment of passive circuit elements to signal conductors of the wafer.

Referring now to FIG. 2, there is shown a wafer 100 of a daughtercard connector in accordance with the preferred embodiment of the present invention. The wafer 100 may be one of a plurality of such wafers that are held together by, for example, a stiffener, such as the stiffener 24 of FIG. 1. The wafer 100 includes a plurality of signal conductors 110 and an insulative housing 102. One or more openings 104 are provided in the insulative housing 102. Each opening 104 exposes a portion of at least one of the signal conductors 110. The signal conductors 110 are more clearly shown in FIG. 3, which illustrates the wafer 100 of FIG. 2 with a portion of the insulative housing 102 removed from the drawing. Note that the signal conductors 110 are arranged as differential signal pairs, with a first distance between signal conductors of a differential pair smaller than a second distance between signal conductors of adjacent differential pairs. However, it should be apparent to one of ordinary skill in the art reading this specification that the present invention and its concepts can be applied equally as well to single-ended signal connectors.

Each signal conductor 110 has a first contact end 112, a second contact end 114 and an intermediate portion 116 therebetween. The intermediate portion 116 of the signal conductor 110 is disposed within the insulative housing 102. Preferably, the wafer 100 also includes a ground conductor member or a shield plate having a first contact end 122 and a second contact end 124. The configuration of the shield plate may be similar to the shield plate of FIG. 1. The first contact ends 112, 122, which are illustrated as press-fit "eye of the needle" contact ends, are connectable to a first printed circuit board (not shown). The second contact ends 114, 124 are connectable to a mating connector (not shown), such as the backplane connector 50 of FIG. 1. Although the first contact ends 112, 122, are shown as press-fit eye of the needle contact ends, they may instead be configured to be electrically connected to any suitable electrical cable, such as, but not limited to, a flat ribbon cable. It will also be appreciated by those skilled in the art that the longitudinal axes of the first and second contact ends 112, 114 do not have to be oriented at right angles to each other, but could be oriented at any suitable angle.

Attached to the intermediate portion 116 of each signal conductor 110 is a passive circuit element 140. Preferably, the passive circuit element 140 includes at least a capacitor, resistor, or an inductor, which may be housed in an insulative package 138 and is, for example, a commercially available off-the-shelf component. For example, if the passive circuit element 140 is desired to function as a direct current blocking circuit, then one of the ceramic or tantalum chip capacitors that are sold by KEMET Electronics Corporation of Greenville, S.C., may be utilized. The technical information for these ceramic or tantalum chip capacitors are available from KEMET (www.kemet.com) and are incorporated by reference herein. If the passive circuit element 140 is desired to function as a high frequency passive equalization circuit, then one of the resistor/inductor/capacitor packages that are sold by Maxim Integrated Products, Inc. of Sunnyvale, Calif. may be utilized. The technical information for these packages are available from Maxim (www.maxim-ic.com) and are incorporated by reference herein. It should be noted that while the preferred embodiment is directed to a two-piece (daughtercard connector and backplane connector), shielded, differential pair connector assembly, the concepts of the invention are applicable to a one-piece connector, an unshielded connector, a single-ended connector or any other type of electrical connector. The circuit element 140 may also be an active circuit element connected to a power conductor (described below). For instance, the circuit element 140 may be a filter, common mode filter, high frequency coupler, or a high frequency transformer.

Figure 4:
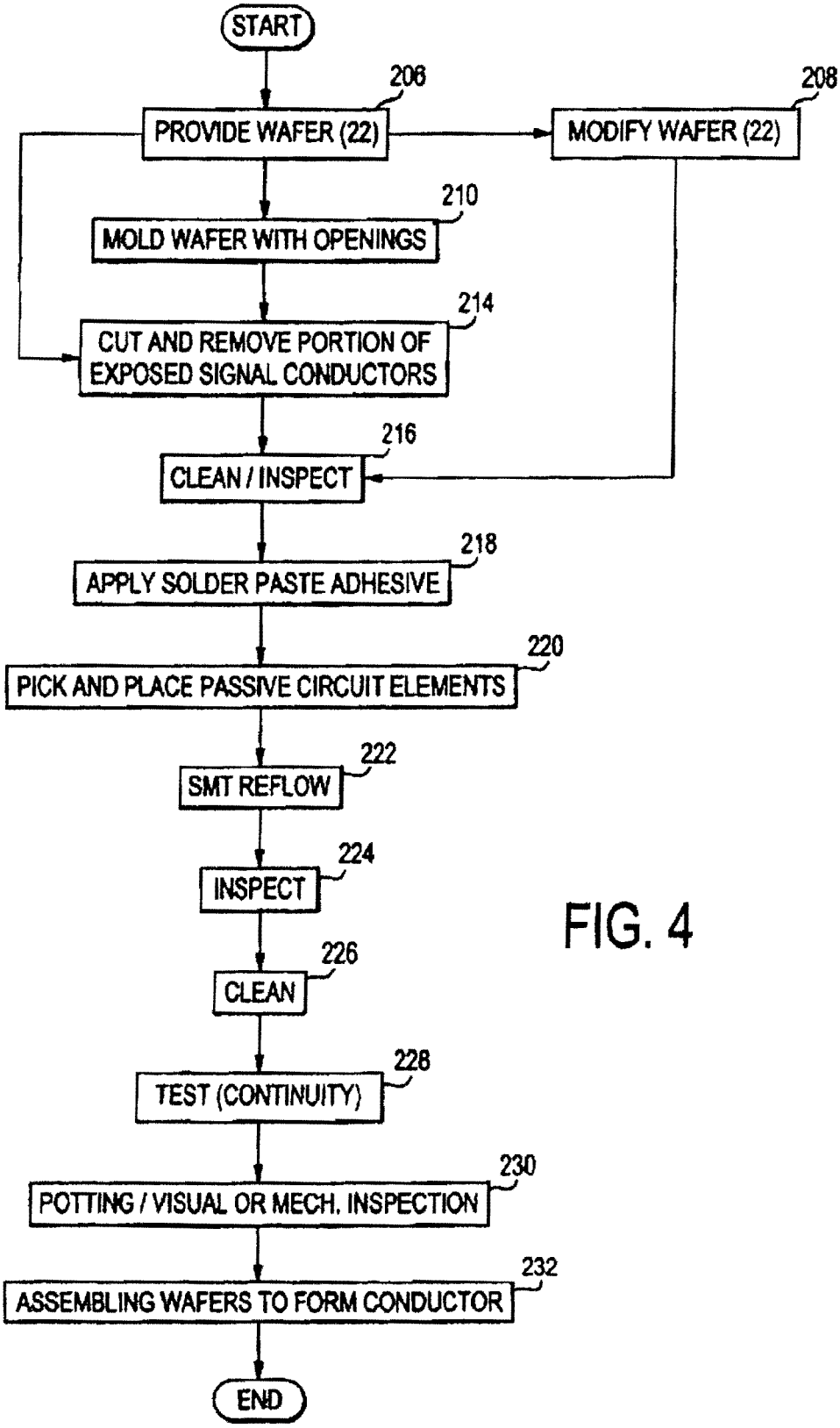
FIG. 4 shows a flowchart of a preferred manufacturing process for the connector in accordance with the present invention.

Referring now to FIG. 4, there is shown a flowchart 200 of a preferred manufacturing process for a connector in accordance with the present invention. This flowchart 200 illustrates the process steps for modifying and adapting an existing connector, such as the daughtercard connector 20 of FIG. 1, to provide the desirable passive circuit elements. It should be apparent to one of ordinary skill in the art that as the various process steps of the flowchart 200 are described, some of the steps need not be included in order to manufacture a connector in accordance with the present invention. Furthermore, the sequence of some of the steps may be varied.

The process steps of the flowchart 200 may be implemented beginning with Step 206 in one embodiment of the present invention, or with Step 210 in another embodiment of the present invention. Step 206 describes providing an already assembled connector (e.g., daughtercard) having one or more wafers that are to be modified in step 208 to create an insulative housing 102 around the plurality of signal conductors 110 in the wafers, and to include openings defined through which an exposed area of each of the signal conductors 110 are accessible.

Generally speaking, the signal conductors 110 shown in, for example FIG. 4, are stamped from a flat metal sheet along with bridge pieces or tie bars (not shown) to hold the conductors in position during subsequent processing steps, including during the step when plastic is shot around the conductors. In the process shown in FIG. 4, for example, one starts with metal stamping. Ground conductors cannot, in the final product, be shorted together; therefore, once they are fabricated by stamping as noted above, the bridge pieces/tie bars are removed after the conductors are molded in place. Then if a gap 152 in the signal conductors 100 is needed (as shown, for example, in FIG. 5) for insertion of components, the gaps are formed. The insulative housing is formed using this same plastic overmolding process.

Figure 6:
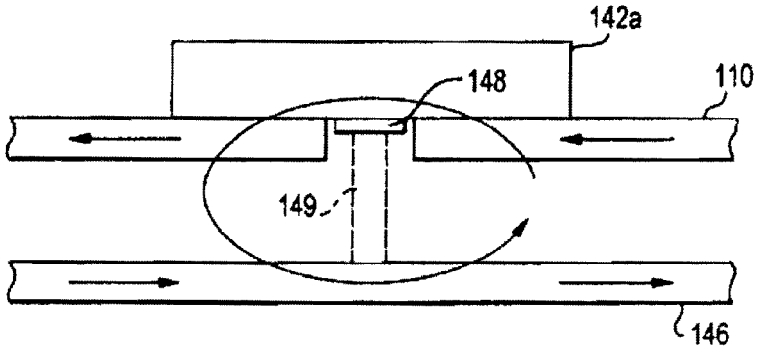
FIG. 6 shows a circuit element coupling a differential pair of signal conductors according to an embodiment of the present invention, with a preferable gap or break in the conductors.

The flat metal sheet may also be stamped such that, as shown in FIG. 6, an optional T- or L-shaped conducting connecting member 149 is provided which extends approximately perpendicular to the plane of the ground conductor 146 for attachment to a pad 148 located on the circuit component 142*a*. The conducting connecting member 149 could also extend approximately perpendicular to the ground conductor 146 in a different plane depending upon the orientation of the ground conductor 146 relative to the signal conductor 110 and circuit component 142*a*. That is, instead of extending upward as shown in FIG. 6, it would extend into the page at an angle that is 90-degrees relative to the direction shown in the figure in order to accommodate the ground conductors 146 being placed substantially co-planar with the conductors 110 and circuit element 142*a*.

Electrical coupling occurs when a current loop between the circuit element 142*a*, the signal conductor 110, and the ground return conductor 146 of one signal conductor, becomes coupled to a similar current loop in a second, nearby circuit element/signal conductor/ground. That is, as shown in FIG. 6, when signal leads extend over conductors, and with a component circuit element 142*a* on top of the conductors, a local induced magnetic field forms a current loop. When the circuit element 142*a* is moved further away from the ground return conductor 146, the current path through the circuit element 142*a* is also farther from the ground 146. When this happens, the area of the current loop associated with the circuit element 142*a* is larger, which produces a larger self inductance of this element and increased mutual inductance between this circuit element 142*a* and nearby circuit elements.

Alternatively, if an already assembled connector is not provided, Step 210 shown in FIG. 4 describes providing a wafer, such as a wafer 22 of FIG. 1. At Step 210, during the molding of the insulative housing around the plurality of signal conductors, openings 104 are defined, through which an exposed area of each of the signal conductors 110 is accessible. Preferably, the openings 104 are provided adjacent the intermediate portions 116 of the signal conductors 110. Note that the plurality of signal conductors 110 are preferably stamped from a lead frame, as is known in the art. Typically, the signal conductors 110 are made of a solder wettable material, such as beryllium-copper or the like, and intermediate portions 116 of the signal conductors 110 may be coated with nickel or other non-solder wetting material. In this case, the exposed area of the signal conductors is provided with solder wettable material, such as tin-lead coating.

Figure 5:
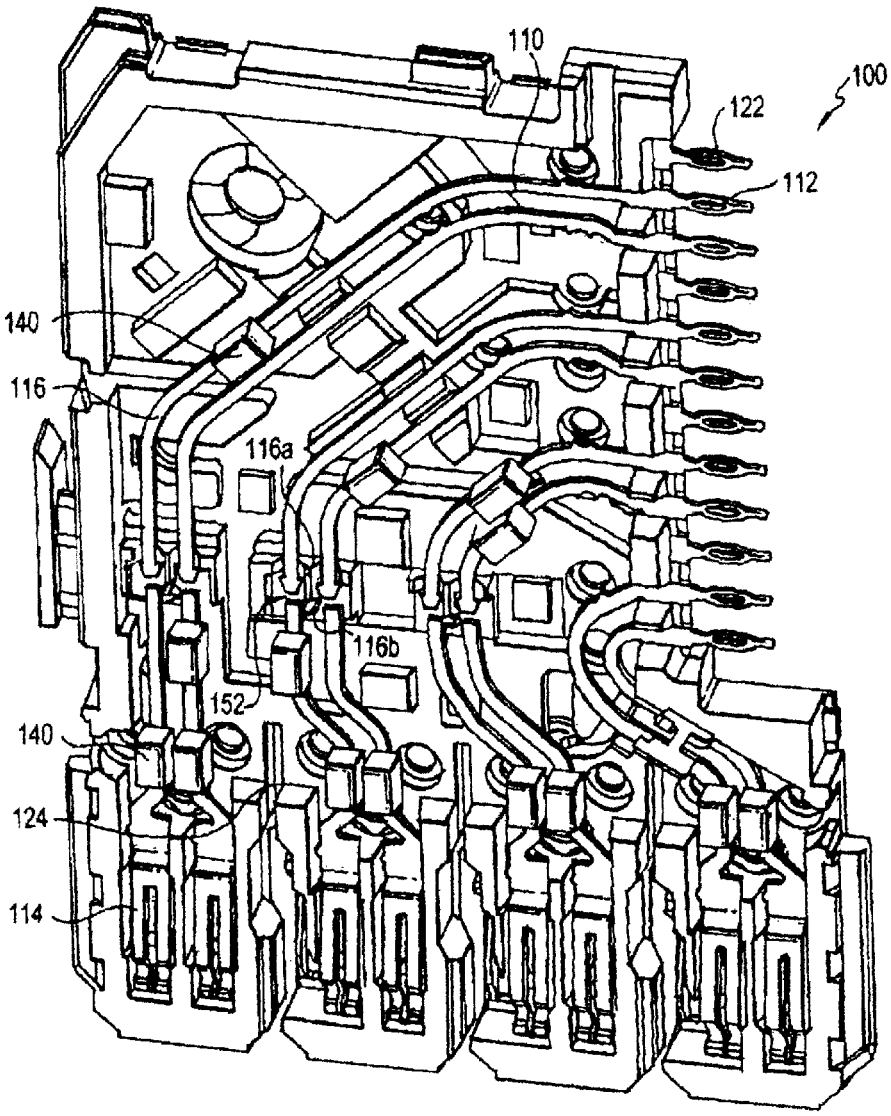
FIG. 5 shows a perspective view of the wafer of FIG. 3, with some of the passive circuit elements removed from the drawing to better illustrate portions of the signal conductors to which the passive circuit elements are attached.

Step 214 describes cutting and removing a portion of the exposed area of the signal conductors 110 to provide a gap 152 in the signal conductors 110, so that only a portion of the exposed area remains. FIG. 5 is a another view of the wafer 100 of FIG. 3, with two of the passive circuit elements 140 removed to show the remaining portions 116*a*, 116*b* of the exposed area of the signal conductors 110. The remaining portions 116*a,b* are the ends sections of the conductors 110 that are formed when the gap 152 is created. Step 216 describes cleaning and inspecting the signal conductors 110 after the cutting and removing step 214. This step can be performed manually or automatically, and can be bypassed if desired.

Step 218 describes applying solder paste or conductive adhesive to the remaining portions 116*a*, 116*b* of the exposed area of the signal conductors 110. Step 220 then describes picking and placing passive circuit elements 140 onto the remaining portions 116*a*, 116*b* of the exposed area of the signal conductors 110. Note that the openings in the insulative housing described in step 210 are sized to receive the passive circuit elements 140. And step 222 describes conventional SMT reflow to securely attach the passive circuit elements 140 to the remaining portions 116*a*, 116*b* of the exposed area of the signal conductors 110. While the preferred method of step 218 is to apply the solder paste or conductive adhesive to the remaining portion 116*a*, 116*b* of the exposed area of the signal conductors 110, it should be apparent to one of ordinary skill in the art that the solder paste/conductive adhesive may instead be applied to the passive circuit elements 140 or to both the remaining portion 116*a*, 116*b* of the exposed area of the signal conductors 110 and the passive circuit elements 140 as desired.

Steps 224 and 226 respectively describe inspecting and cleaning the attachment area around the passive circuit elements 140 and the remaining portions 116*a*, 116*b* of the exposed area of the signal conductors 110. Steps 228 and 230 respectively describe testing for electrical continuity across the attachment area and potting/visual or mechanical inspection as required. Finally, step 232 describes assembling a plurality of wafers 150 to form a connector in accordance with the preferred embodiment of the present invention.

While the flowchart 200 illustrates cutting and removing a portion of the exposed area of the signal conductors 110 (step 214) after the insulative housing has been molded around the plurality of signal conductors, it is certainly possible, and in some cases even preferable, to cut and remove the portion of the exposed area of the signal conductors before the insulative housing has been molded around the plurality of signal conductors. The molded insulative housing will define openings through which the remaining portion of the exposed area of the signal conductors will be accessible.

In an alternative manufacturing process (not shown) for a connector in accordance with the present invention, a passive circuit element (preferably a capacitive element) may be provided as follows: (i) providing a first lead frame which includes a plurality of first signal conductors, with each of the plurality of first signal conductors having a first contact end and an intermediate portion; (ii) providing a second lead frame which includes a plurality of second signal conductors, with each of the plurality of second signal conductors having a second contact end and an intermediate portion; (iii) positioning the plurality of first signal conductors and the plurality of second signal conductors adjacent one another such that for each first signal conductor there is a corresponding second signal conductor adjacent thereto; (iv) attaching at least a segment of the intermediate portion of each first signal conductor to at least a segment of the intermediate portion of the corresponding second signal conductor with a dielectric material provided therebetween so as to provide a capacitive element; and (v) providing an insulative housing around at least a portion of each of the plurality of first and second signal conductors. In this process, the attached intermediate portions of the first signal conductor and the second signal conductor serve as capacitive plates to provide the desired capacitive characteristics. Other applicable steps from FIG. 4 can then be utilized as needed.

Figure 7:
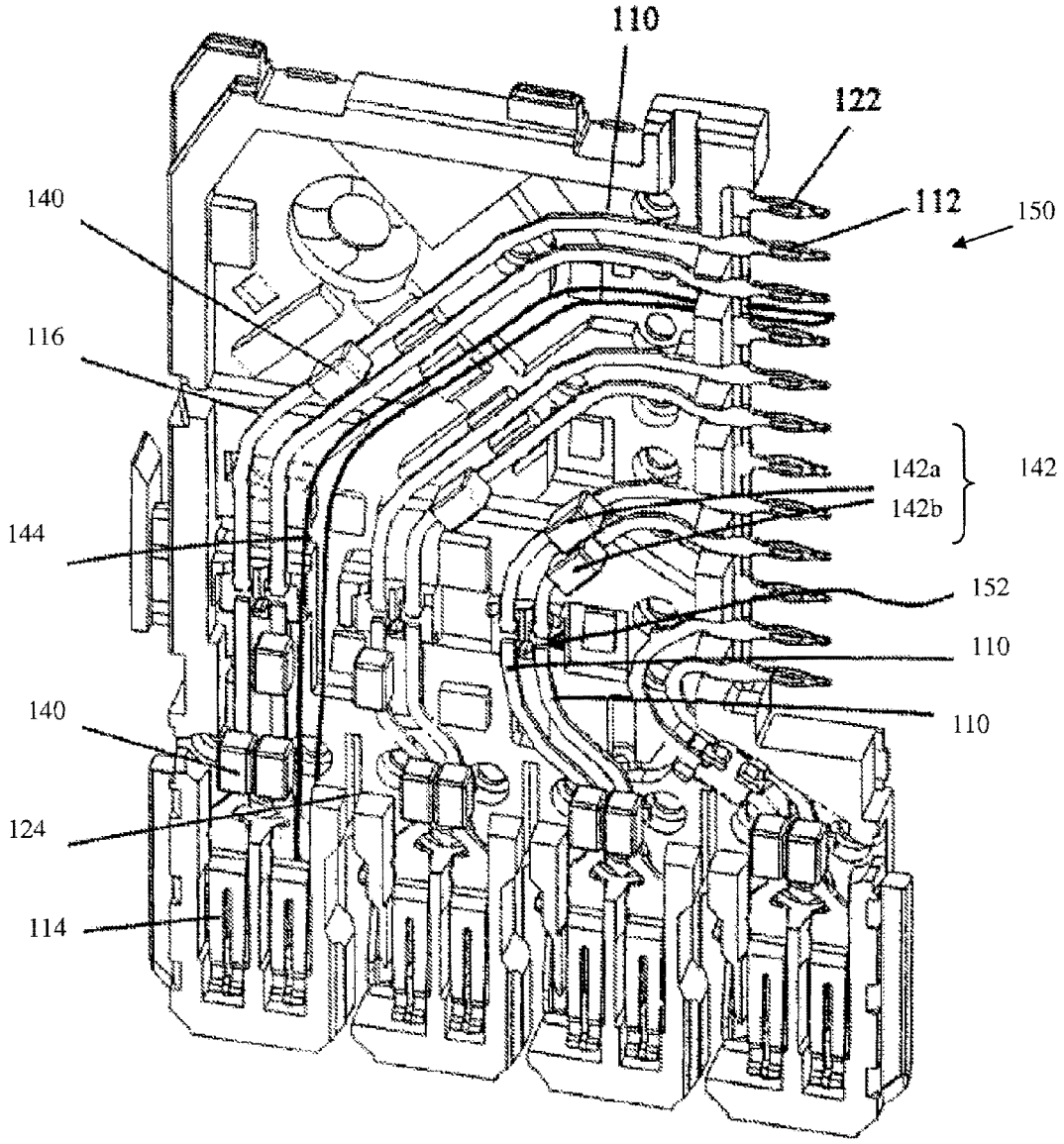
FIG. 7 shows a wafer having a power conductor.

Referring to FIG. 7, there is shown a perspective view of a wafer 150 of a daughtercard connector in accordance with another embodiment of the present invention. The wafer 150 may be one of a plurality of such wafers that are held together by a stiffener, such as the stiffener 24 of FIG. 1. The wafer 150 of FIG. 7 is similar to the wafer 100 of FIG. 2, with the substantive difference being the presence of additional passive circuit elements 140 along the intermediate portions 116 of the signal conductors 110. Note that in the wafer 150 illustrated in FIG. 7, all but two signal conductors that are shortest in length are provided with two passive circuit elements 140 each. In some simulations, it has been shown that having additional passive circuit elements 140 provides better desired qualities, such as high frequency passive equalization. It should be noted that the desirable number of passive circuit elements 140 is not limited to one or two per signal conductor, but rather depends on various other factors, including the structure and electrical characteristics of the connector. Thus, more than two passive circuit elements 140 can be provided.

As further shown, a pair of passive circuit elements 142*a,b* are provided on the differential signal conductor pairs 110. The passive circuit element pairs 142*a,b* are shown juxtaposed next to each other but also spaced slightly apart from one another along the longitudinal axis of the respective signal conductors 110 to which they are connected. That is, the pair of circuit elements 142*a*, hare not aligned directly next to each other (like the passive circuit elements shown at the bottom of the embodiment). Rather, the pair of passive circuit elements 142*a,b* are staggered slightly apart, as shown, to reduce the effects of electrical coupling.

Figure 8:
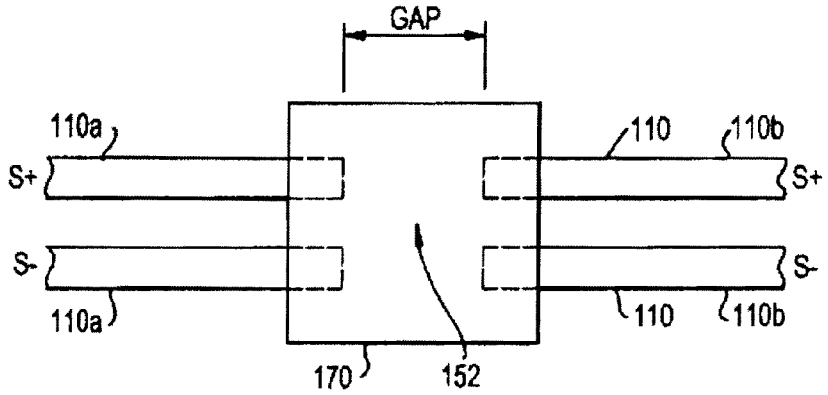
FIG. 8 shows a circuit element coupling a differential pair of signal conductors according to another embodiment of the present invention.

Following along from one end of one of the conductors 110 of the conductor pair, from the first contact end 112 to the second contact end 114, there is shown two passive circuits 140 in two locations, and at least one gap along the conductor 110 that does not have 140, the conductor pairs 110 would not have any gaps 152. However, if components 142 are to be included, the gap 152 is formed along the length of at least one of the conductors 110 of the conductor pair and soldered across the gap 152 (it could also be soldered in such a way that it connects across side-by-side gaps located in both of the conductors of the conductor pair, i.e., by connecting with four, rather than just two, leads). The passive circuit elements 142*a,b* could be replaced with a single passive circuit element 170 (as best seen in FIG. 8) that connect across both conductors 110.

Though only elements 142*a* and 142*b* are shown staggered, one or more of the other passive circuit element pairs shown in FIG. 7 can also be staggered to reduce the effects of electrical coupling. However, the pair must not be staggered too far apart, because then the circuit elements will not be balanced. The optimal distance is about one-half to one length of the circuit element, depending on a given wafer 100 configuration.

FIG. 7 illustrates an embodiment of the invention in which a ground conductor plate is separated from respective signal conductors 110 for shielding purposes (press-fit contact end 122 is attached to the ground conductor plate). Thus, the signal conductors 110 are positioned substantially side-by-side and substantially co-planar over the ground conductor plate.

FIG. 7 also shows the use of an alternative conductor 144 having first and second ends, which can carry power or can be a ground contact between the operable connection ends of the wafer 150. The alternative conductor 144 only needs to be provided on one side of the wafer 150. However, the location of the conductor 144 is exemplary and can be any suitable location on the wafer 150. More than one conductor 144 can be provided, and the conductor 144 need not extend the entire length of the wafer 150. In the case of the conductor 144 that carries power or provides aground, the break 152 may not be necessary or desired.

Referring to FIG. 8, power may also be provided by having phantom direct current power on the s+ and s− conductor leads of the conductors 110. That is, the pair s+, s− have a gap or break, and a passive circuit element 170 that needs power bridges that gap. Another way to understand the phantom direct current power arrangement is to use signal conductors s+, s− and a signal frequency greater than about 1 MHz combined with a DC supply power voltage between s+ and s− to provide power on one side of the circuit element 170, such that, if the circuit elements 170 are insensitive to DC voltage, a DC voltage across the circuit element 170 would be formed (e.g., a signal coming from conductor 112, the s+ and s− would have simultaneous sum of two voltages: one exclusively above 1 MHz plus one to supply power, the circuit elements 170 would modify the signal but use the DC voltage for power but not pass along to the other end 114.

Referring momentarily back to FIG. 7, every third terminal contact, counting down from the press-fit contact which is labeled as 122 (not including the alternative conductor 144), connects to the ground plate below the conductors 110 and the passive circuit components 142. This allows the ground conductors 122 to be co-planar underneath the pair circuit conductors and be ground to a ground plate. An alternative is to use the alternative conductor 144, or multiple conductors 144, positioned next to the pairs of signal conductors 110. The alternative conductors 144 may carry power or be ground conductors. If the alternative conductors 144 are ground conductors, a ground plate and the press-fit ground contacts 122 would not be needed. Because the alternative conductors 144 are more or less in the same plane as the passive circuit components 142 and the signal and ground conductors 110, the passive circuit components 142 can be attached to the wafer 150 relatively easily.

However, if the need exists to use the ground plate, a T-shaped or L-shaped conductor member 149 extending up from the ground plate could be used, as discussed and shown with respect to FIG. 6. Thus, returning to the embodiment shown in FIG. 8, the bottom ground plate G could be a plate with a projection extending up to and connecting with the bottom of the circuit element 170 (i.e., using a voltage pin; not shown), or if no bottom ground plate G is present, a narrow conductor connecting the ground contacts 122 running next to signal pairs 110 could be used. In the embodiment shown in FIG. 8, a voltage power conductor v+and aground conductor can be added. The ground plate G could be co-planar with the separate ground conductors.

The circuit element 170 shown in FIG. 8 is another aspect of the present invention in which the passive circuit element is electrically connected to a pair of signal conductors 110. Preferably, the circuit element 170 spans the gap 152 in the signal conductors, which electrically separates the signal conductors 110 into first and second segments 110*a*, 110*b*. The gap 152 between two successive sections of the same conductor or between sections of two adjacent conductors may be fabricated by stamping or other techniques.

Figure 9:
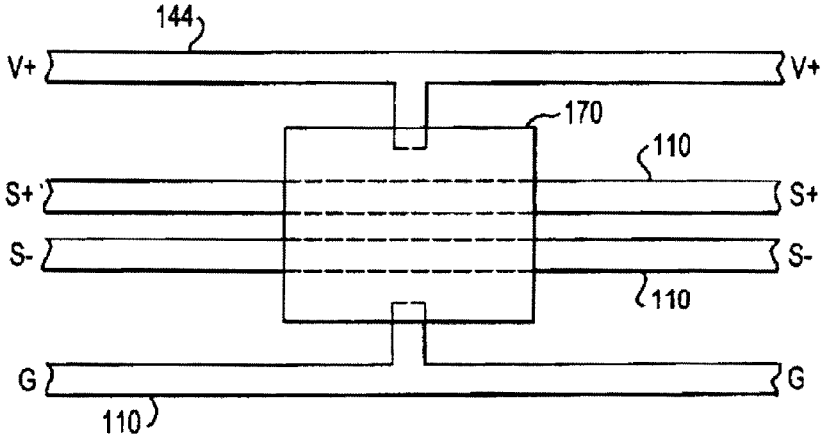
FIG. 9 shows a circuit element coupling a differential pair of signal conductors according to one embodiment of the present invention, optionally without the gap or break in the conductors.

Referring to FIG. 9, the signal conductors 110 are shown side-by-side with circuit element 170 (as in FIG. 8), but in addition to conductor plate G below those elements, a co-planar power conductor 144 is provided on one side of the circuit element 170 that attaches to the side or bottom of the circuit element 170. Alternatively, the ground conductor plate G could be replaced with another conductor 144 to balance the other conductor such that they are co-planar. This type of side-by-side conductor arrangement is particularly useful for higher speeds.

The circuit element 170 may be a passive or active circuit element. A single passive circuit element covers s+ and s− leads, which usually have a break or gap 152, but they may also be continuous leads as shown. If powered, the circuit element 170 is electrically connected to the power conductor 144 and to ground 110, as shown (though the element 170 can be powered in other suitable ways). In the embodiment shown, the circuit element 170 connects a pair of signal conductors 110. The ground conductor 110 is on the shielded plate, and therefore must extend through the insulative housing 102. Alternatively, the ground conductor 110 can be provided on top of the insulative housing 102, similar to the power conductor 144. When the ground conductor G is provided in the same plane with the signal conductors s+ and s− 110 (the pair conductors over a planar ground return, the co-planar are peripherally on one or both sides), the arrangement has certain benefits. For instance, the spacing can be maintained more accurately because it is stamped from a plate using a die, and also because if components are to be attached to all leads, it is much easier to attach components when everything is in the same plane. Also, if a ground is in the plate, a lead that would be in the same plane.

Figure 10:
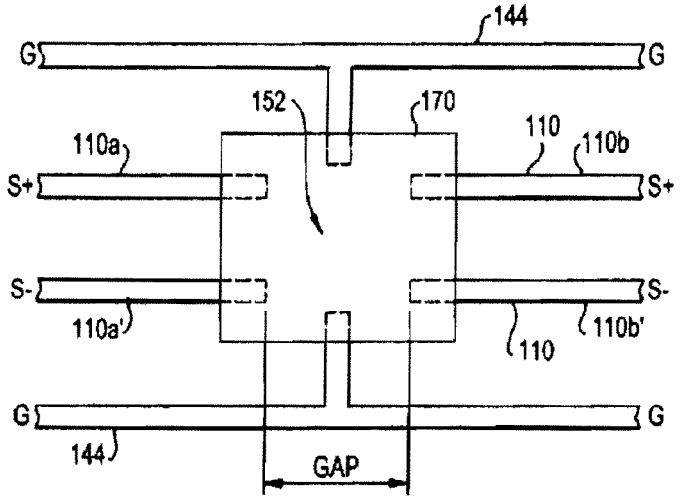
FIG. 10 shows a circuit element on top of conductors in another embodiment of the invention.

Although the gap 152 in the signal lines 110 is not provided in FIG. 9, the most likely configuration is with the signals 110 having the gap 152. For example, as shown in FIG. 10, an exemplary circuit element 170 according to another aspect of the present invention is shown. In this embodiment, a passive circuit 170 is electrically connected to two signal conductors 110, and to two ground conductors 144 (which alternatively may be the shield plate 122). The circuit element 170 spans or bridges the gap 152 in the signal conductors s+ and s− 110. The circuit element 170 also spans or bridges a break in the ground conductors 144. The gap 152 electrically separates the signal conductor 110 into first and second segments 110*a*, 110*b*. Thus, there may be up to six terminals: s+, s−, s+, s−, G (proximate one side), and G (proximate another side). The benefit of the arrangement shown is that a differential filter, direct current sourcing, and reflection reducing or impedance matching characteristics are all packaged in the circuit element 170, which may be an electrical component generally, or more specifically, an active or passive filter component providing one or more functions such as an equalizer or EMI filtering. Another benefit is that the ground connections are symmetrically arranged.

Alternatively, the circuit element 170 could extend up and over and overlap with the ground conductors 144 to enable an attachment of the ground conductors 144 to a pad 148 (FIG. 6) on the bottom of circuit element 170. Also, power could be supplied as a DC voltage between s+ and s−, or between s+, s−, and the grounds.

It will be appreciated by those skilled in the art that the signal conductors 110 do not have to be linear at the point where the circuit element is attached, as illustrated thus far, but may instead include bends along the length of the signal conductors. Moreover, the gaps 152 between the first and second segments of a signal conductor may be such that the longitudinal axis of each segment is not perfectly coaxial. In addition, more than one circuit element 170 can be provided in any connection configuration (FIGS. 6, 8, 9, 10).

Figure 11:
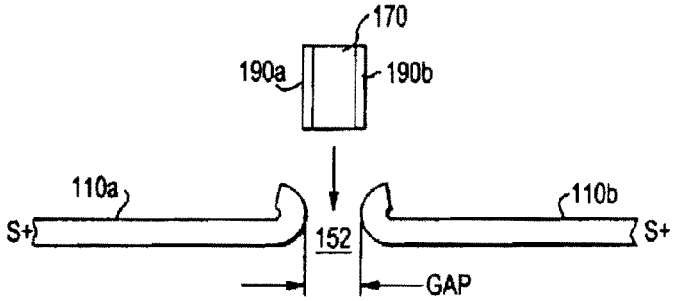
FIG. 11 shows an elevation view of a circuit element in a pre-connected position relative to a signal conductor of the wafer.

Turning to FIG. 11, there is shown another alternative configuration for the circuit element 170 to connect to the two leads of a signal conductor 110, in which the circuit element 170 has connection portions 190*a*, 190*b*. The circuit element 170 is shown in an unconnected position. As indicated by the arrow, the circuit element 170 is moved into the gap 152 between the signal conductor segments 110*a* and 110*h*. In the connection position, the circuit element 170 is between the segments 110*a,b*, which completes the electrical circuit for the signal conductor 110. The leads of the signal conductor segments 110*a* and 110*b* are turned up so that the circuit element 170 is received in the gap 152 without stubbing. The connection portions 110*a*, 110*b* may be a resilient spring, a lance, a cantilevered flange, a pin, or the like, which creates a secure, but reversible, friction fit when the circuit element 170 is in the connected position. The mechanical connection portions 110*a*, 110*b*, could instead be a conductive adhesive that secures the circuit element 170 in the connected position. The conductive adhesive is, preferably, one that has a melt point at least higher than the temperatures that the adhesive is exposed to during the manufacturing of the wafer 100 (i.e., the temperature of, for example, reflow soldering).

Figure 12:
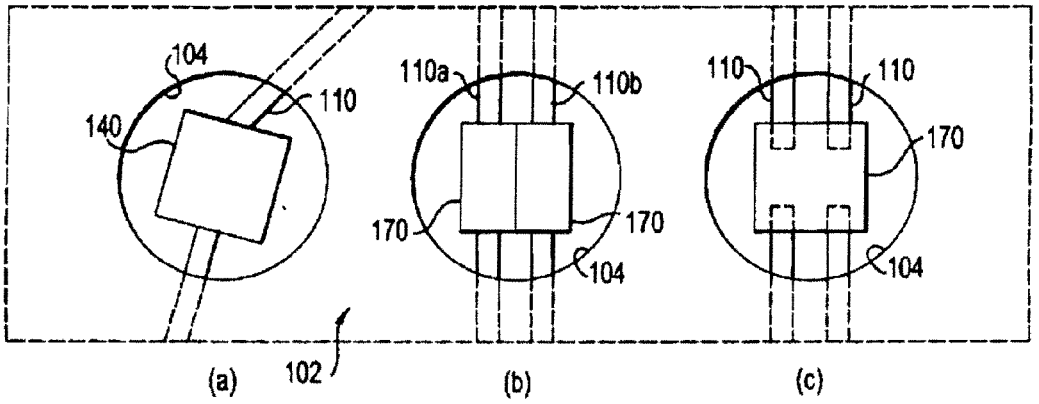
FIG. 12 shows a plan view of a portion of the wafer of the daughtercard connector shown in FIG. 2.

Referring now to FIG. 12, there is shown a portion of the insulative housing 102 as seen in FIG. 2. The insulative housing includes several openings 104 that expose the signal conductors 110 of the wafer 100. The openings 104 may be used to provide a relatively flat and/or clear insulative area of potential connection for circuit elements 140 to be connected to the signal conductors 110. Various configurations of opening 104, signal conductor(s) 110, circuit element 170, and gaps 152 between segments of signal conductors 110 are shown in FIG. 12. For example, the opening 104 shown in FIG. 12(*a*) is large enough to include a single conductor 110 and a single circuit element 140. The opening 104 shown in FIG. 12*b* is large enough to include two signal conductors 110*a*, 110*b*, each with a respective circuit element 170. The circuit element 170 do not have to be positioned next to each other as shown, but could instead be spaced apart along the longitudinal axis of the signal conductors 110*a*, 110*b*, respectively, in order to reduce the effects of coupling. The opening 104 shown in FIG. 12*c* includes four terminals exposed in the opening 104 that are electrically connected by the circuit element 170. The opening 104 is constructed so as to be adapted for screen printing or other application of one or more patterns and or layers of resistive, conductive, dielectric, or magnetically permeable materials in the form of a thick film or thin film or individual pieces. A laser or other trimming process may be used to adjust the resulting component values to achieve desired characteristics.

Figure 13:
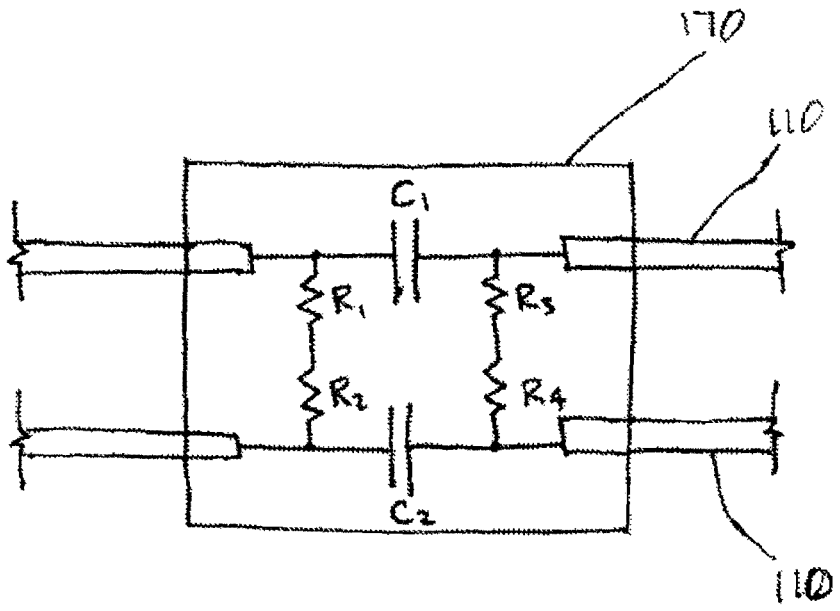
FIG. 13 shows a circuit element coupling two differential pairs of signal conductors according to another embodiment of the present invention.
Figure 14:
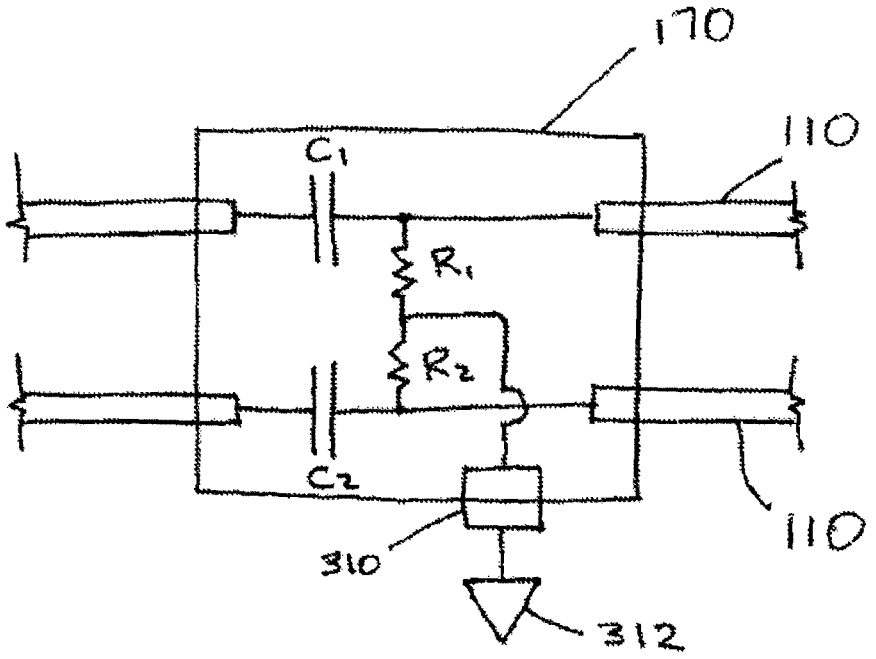
FIG. 14 shows a circuit element coupling two differential pairs of signal conductors according to yet another embodiment of the present invention.

Referring to FIG. 13, a circuit element 170 is electrically connected to two signal conductors 110. The circuit element 170 is a passive circuit element containing two capacitors $C_1$ and $C_2$ and resistors $R_1$ through $R_4$. Resistors $R_1$ and $R_2$ could be combined into a single resistor; and resistors $R_3$ and $R_4$ could be combined into a single resistor. One function of such resistors is to provide DC current paths between positive and negative signals. Alternatively, to provide impedance matching to reduce reflections of signals, $R_1$ and/or $R_3$ could be replaced by an inductor. FIG. 14 shows another circuit element 170 that is electrically connected to two signal conductors 110. The passive circuit of the circuit element 170 includes two capacitors $C_1$ and $C_2$, two resistors $R_1$ and $R_2$, which resistors connect to a ground reference conductor 312 by means of a ground tab or terminal 310.

As noted above, electrical coupling can be a problem when circuit elements of an interconnection device like the wafer 100 of the present invention are in close proximity to each other. One method of reducing the coupling effect is to stagger the circuit elements 170. However, it is desirable to further reduce undesirable coupling between distinct pairs of signals. Each differential pair of signals in an interconnection device effectively carries its own virtual ground plane with it due to cancellation effects. The incorporation of a lossy material positioned between one differential pair of signal conductors and a second such differential pair, whether or not there are any grounded conductors or ground shield either adjacent to those pairs of conductors or anywhere within the interconnection device, further reduces the coupling effect.

Figure 15A:
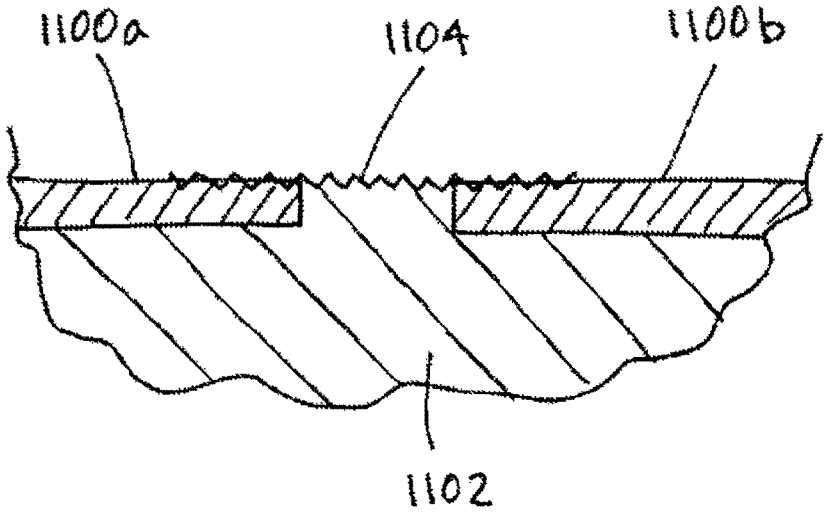
FIG. 15A shows a partial cross-sectional elevation view of signal conductor segments that are positioned on a portion of an insulative housing according to one embodiment of the present invention.
Figure 15B:
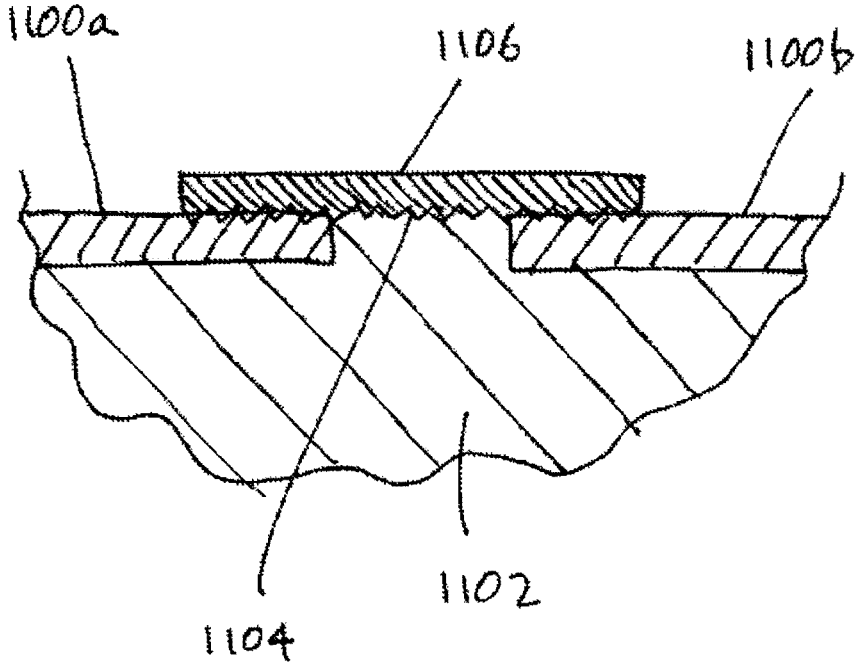
FIG. 15B shows the partial cross-sectional elevation view of FIG. 15A having an applied thick film.
Figure 15C:
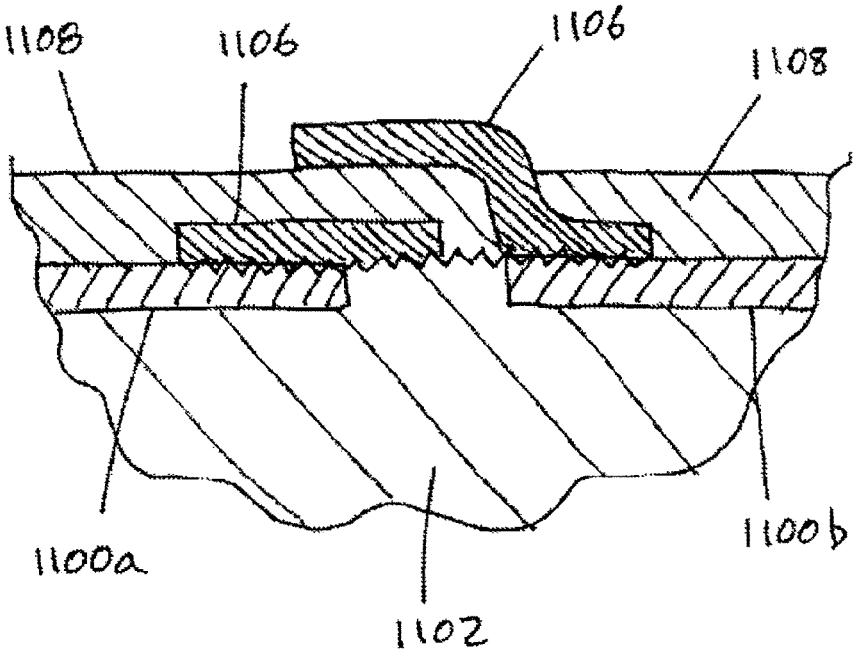
FIG. 15C shows another partial cross-sectional elevation view of signal conductor segments and an applied thick film according to a another embodiment of the present invention.

Referring to FIGS. 15A-C, various configurations of the circuit elements and the signal conductors are shown during manufacturing, before and after the addition of a lossy material. FIG. 15A shows a partial cross-sectional elevation view of the signal conductor segments 1100*a* and 1100*b* that are positioned on a portion of an insulative housing 1102. A portion of the surface of the signal conductor segments 1100*a*, 1100*b*, is fabricated or manipulated in such a way as to create a roughened or grooved surface 1104, which is then capable of better accepting a coating of a thick film 1106 as shown in FIG. 15B. The thick film 1106 may be etched to achieve a desired level of resistance through the thick film 1106 material. FIG. 15C shows another configuration of the thick film 1106 relative to the two signal conductor segments 1100*a*, 1100*b* and an insulative layer 1108.

The thick film 110*b* is preferably a lossy material, including a lossy conductor material such as carbon or a carbon-particle-filed polymer resin matrix. The material conductivity is preferably between about 1:100 and about 1:1,000,000 of that of standard pure copper. A lossy dielectric, such as a lossy polymer resin, or a lossy magnetic material, such as ferrite or ferrite-particle-filled polymer resin matrix, may also be used.

As an alternative to the use of a lossy material, shield, shield plates, or other shield contacts or conductors fabricated from high-conductivity metallic or other material which has from about 10 to 100-percent of standard pure copper's conductivity. However, such highly conductive shields can have higher costs, create undesirable cavity resonances, or radiation or crosstalk characteristics, and the need to connect such shields to other ground conductors in the parts of the wafer 100 that are joined together by the wafer 100. The lossy material avoids those disadvantages.

Having described the preferred embodiment of the invention, it will now become apparent to one of ordinary skill in the art that other embodiments incorporating their concepts may be used. Accordingly, these embodiments should not be limited to disclosed embodiments but rather should be limited only by the spirit and scope of the appended claims. Although certain presently preferred embodiments of the disclosed invention have been specifically described herein, it will be apparent to those skilled in the art to which the described herein may be made without departing from the spirit and scope of the invention. Accordingly, it is intended that the invention be limited only to the extent required by the appended claims and the applicable rules of law. All publications and references cited herein are expressly incorporated herein by reference in their entirety.

The invention claimed is:

1. An electrical connector configured to electrically connect a first electrical device and a second electrical device, the electrical connector comprising:

an insulative housing comprising at least one opening disposed therein;

a signal conductor comprising a first segment and a second segment that is spatially separated from the first segment to form a gap therebetween, wherein a portion of the first signal conductor is disposed within the insulative housing, and wherein the gap is accessible at the at least one opening;

a circuit element disposed in the at least one opening and electrically connected to the first and second segments to bridge the gap;

a conducting connecting member electrically connecting the circuit element to at least one of a ground plate and a ground conductor.

2. The electrical connector of a 1, wherein said circuit element is an active circuit element.

3. The electrical connector of claim 1, wherein said circuit element is a passive circuit element.

4. The electrical connector of claim 1, wherein the first and second segments are in a first plane and the at least one of a ground plate and ground conductor are in a second plane different than the first plane.

5. The electrical connector of claim 1, wherein the first and second segments are coplanar with the at least one of a ground plate and ground conductor.

6. The electrical connector of claim 1, wherein the at least one of a ground plate and ground conductor are below the first and second segments, and the conducting connecting member extends though the gap.

7. An electrical connector configured to electrically connect a first electrical device and a second electrical device, the electrical connector comprising:

an insulative housing;

a signal conductor comprising a first segment and a second segment that is spatially separated from the first segment to form a gap therebetween;

a circuit element electrically connected to the first and second segments to bridge the gap;

a conducting connecting member electrically connecting the circuit element to at least one of a ground plate and a ground conductor.

8. The electrical connector of claim 7, wherein said circuit element is an active circuit element.

9. The electrical connector of claim 7, wherein said circuit element is a passive circuit element.

10. The electrical connector of claim 7. wherein the first and second segments are in a first plane and the at least one of a ground plate and ground conductor are in a second plane different than the first plane.

11. The electrical connector al claim 7, wherein the first and second segments are coplanar with the at least one of a ground plate and ground conductor.

12. The electrical connector of claim 7, wherein the at least one of a ground plate and ground conductor are below the first and second segments, and the conducting connecting member extends though the gap.

13. An electrical connector configured to electrically connect a first electrical device and a second electrical device, the electrical connector comprising:

an insulative housing;

a signal conductor comprising a first segment and a second segment that is spatially separated from the first segment to form a gap therebetween;

a ground conductor; and a circuit element electrically connected to the first and second segments to bridge the gap; and a conducting connecting member electrically connecting the circuit element to the ground conductor.

14. The electrical connector of claim 13, wherein the ground conductor extends substantially parallel to the signal conductor.

15. The electrical connector of claim 13, wherein said circuit element is an active circuit element.

16. The electrical connector of claim 13, wherein said circuit element is a passive circuit element.

17. The electrical connector of claim 13, wherein the first and second segments are in a first plane and the at least one of a ground plate and ground conductor are in a second plane different than the first plane.

18. The electrical connector of claim 13, wherein the first and second segments are coplanar with the at least one of a ground plate and ground conductor.

19. The electrical connector of claim 13, wherein the at least one of a ground plate and ground conductor are below the first and second segments, and the conducting connecting member extends though the gap.

* * * * *